US005108089A

United States Patent [19]

Wilkinson

[11] Patent Number: 5,108,089

[45] Date of Patent: Apr. 28, 1992

[54] PORTABLE, ADJUSTABLE EXERCISE STEP/BENCH

[76] Inventor: William T. Wilkinson, P.O. Box 378, Chesapeake City, Md. 21915

[21] Appl. No.: 659,616

[22] Filed: Feb. 25, 1991

Related U.S. Application Data

[63] Continuation of Ser. No. 533,004, Jun. 4, 1990, abandoned.

[51] Int. Cl.[5] ..... A63B 5/00

[52] U.S. Cl. ..... 482/52; 297/438; 108/12; 248/188; 248/911; 403/3

[58] Field of Search ..... 297/175, 423, 424, 438 X, 297/439, 445, 461; 108/11, 12 X, 19, 155–157, 159; 248/188 X, 188.2, 188.8, 911 X; 403/3 X; 211/207, 208; 272/70 X, 144, DIG. 4

[56] References Cited

U.S. PATENT DOCUMENTS

| | | | |
|---|---|---|---|
| Re. 28,293 | 1/1975 | Bustos | 108/144 |
| 1,764,226 | 6/1930 | Rennack | 108/157 X |
| 3,604,371 | 9/1971 | Cavulucci | 108/156 |
| 3,606,458 | 9/1971 | Attinger | 297/423 |
| 3,653,715 | 4/1972 | Drabet et al. | 297/461 |
| 3,687,092 | 8/1972 | Manning | 108/156 |
| 4,340,218 | 7/1982 | Wilkinson | 272/136 |
| 4,549,767 | 10/1985 | Hampshire et al. | 297/439 |
| 4,561,652 | 12/1985 | Wilkinson | 272/119 |
| 4,597,553 | 7/1986 | Rosabaugh | 272/144 |
| 4,648,593 | 3/1987 | Wilkinson | 272/70 |
| 4,715,075 | 4/1987 | Wilkinson | 272/70 |
| 4,764,296 | 12/1987 | Wilkinson | 108/16 |

FOREIGN PATENT DOCUMENTS

| | | | |
|---|---|---|---|
| 1094825 | 5/1955 | France | 108/156 |

*Primary Examiner*—Gene Mancene
*Assistant Examiner*—L. Thomas
*Attorney, Agent, or Firm*—Connolly & Hutz

[57] ABSTRACT

An exercise step/bench for aerobic climbing and dance includes a base in the form of a horizontal platform having a downwardly and outwardly extending apron disposed at an angle greater than 0° and less than 90°. A leg is mounted against the apron at each corner of the platform. The leg is movable from an active position where it extends downwardly beyond the apron to a stored condition where it is mounted against or in the base within the periphery of the apron.

37 Claims, 4 Drawing Sheets

PORTABLE, ADJUSTABLE EXERCISE STEP/BENCH

CROSS-REFERENCE TO RELATED APPLICATION

This application is a continuation of Ser. No. 533,004, filed June 4, 1990, now abandoned.

BACKGROUND OF INVENTION

Various devices exist for use in an aerobic exercise program. One type of device which has met with great success is a bench or step for aerobic step climbing. For example, I have developed a form of single step climbing during which the user would repeatedly step up and down from a single step. An important feature for making the device capable for widespread appeal and to permit it to be customized to the needs of the particular user, provide height adjustability. In my U.S. Pat. No. 4,340,218 I disclose one manner of achieving this height adjustability. Other later patents of mine disclose useful variations for accomplishing that result.

SUMMARY OF THE INVENTION

An object of this invention is to provide an exercise device for simulating climbing which is compact and lightweight and capable of being conveniently stored and transported.

A further object of this invention is to provide such a device which may offer a wide variety of incremental heights, that are easily and quickly adjustable, to accommodate the needs of the particular user.

A further object of this invention is to provide an unobstructed platform surface so that the user can safely step on and off in any direction.

A still further object is to provide such a device which may be mass produced inexpensively in a simple design.

A yet further object of this invention is to provide such a device which may be used as an elevated platform for warmup exercises.

In accordance with this invention, the exercise device for simulating climbing includes a base which is in the form of a horizontal platform having a downwardly and outwardly extending peripheral apron. The apron is disposed at an angle of from greater than 0° to less than 90° and preferably 20° from the platform so as to conveniently permit the user to step on and off the platform from any direction while providing the necessary stability for the platform. Height adjustment is achieved by a leg mounted in each corner of the platform, preferably against the apron so that the leg is disposed at the same angle as the apron. Each leg itself may be adjustable in its length to provide a certain degree of incremental height adjustment. Additionally, interchangeable legs of different lengths may be used to provide for the variation in height.

In a preferred practice of this invention, the legs are detachably mounted to guides at the corners of the base member. The guides may be in the form of tracks, grooves, channels, holes or post/holes. During the stored condition the legs may be removed and mounted to the base member itself. In an alternative form of this invention the legs may be hinged to the base member at the corners to be movable to and from an active position where the legs support the base member and a stored condition where the legs are hinged into contact with the lower surface of the platform.

THE DRAWINGS

DETAILED DESCRIPTION

Figure 2:
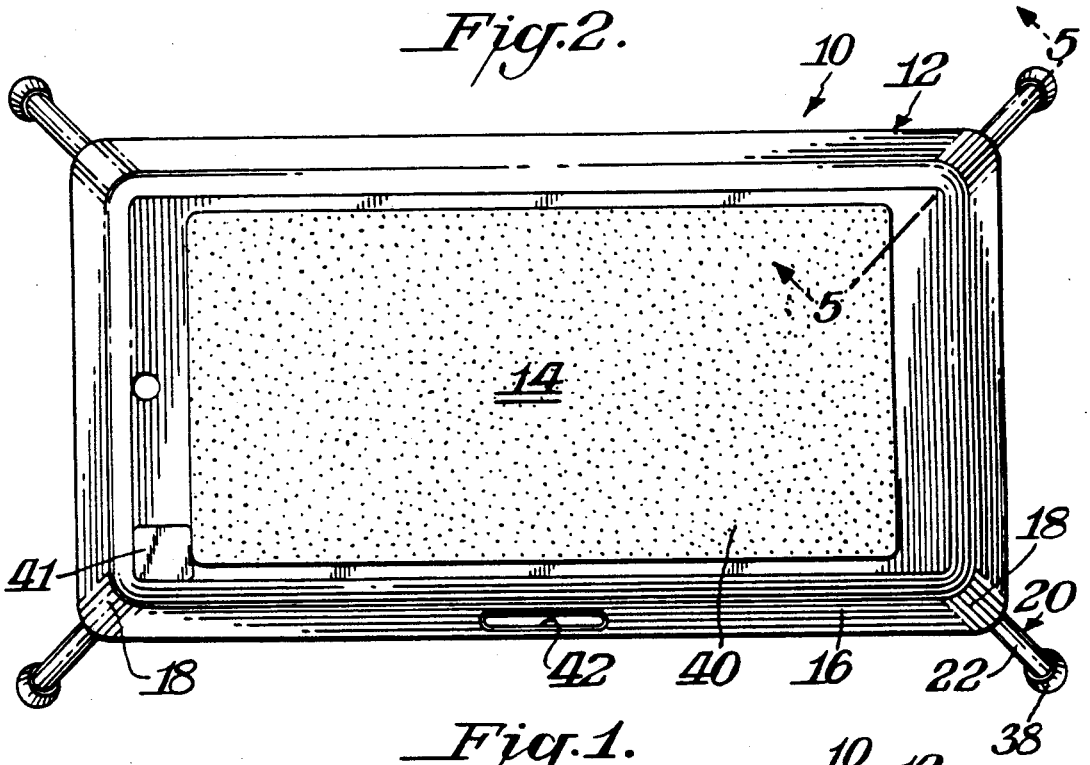
FIG. 2 is a top plan view of the exercise device shown in FIG. 1.
Figure 1:
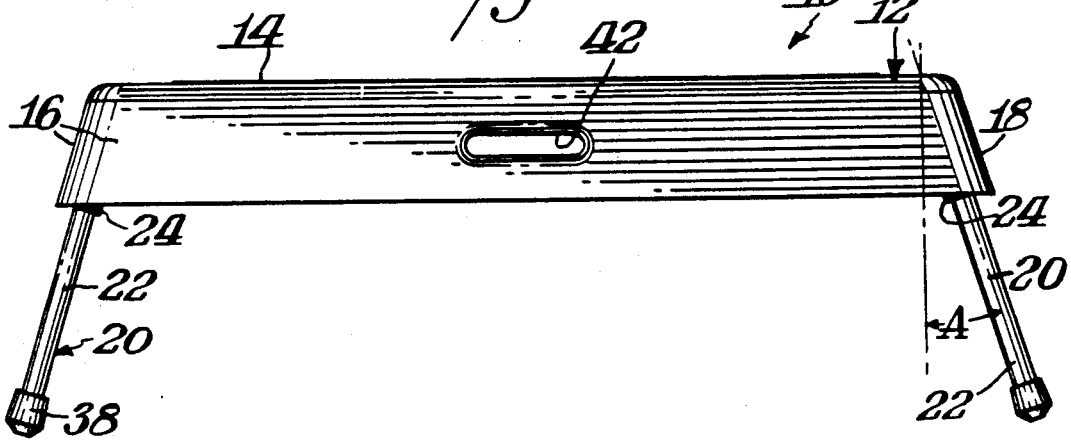
FIG. 1 is a side elevation view partly broken away of an exercise device in accordance with this invention.
Figure 3:
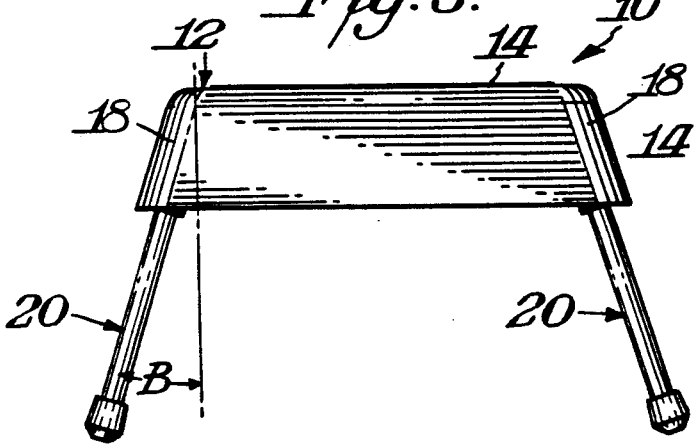
FIG. 3 is an end elevation view of the exercise device shown in FIGS. 1–2.

FIGS. 1–4 illustrate an exercise device 10 for simulating climbing. Exercise device 10 is particularly constructed to be used for single step climbing and aerobic exercise programs wherein the user would repeatedly step onto and off from a base 12 which functions as a step or bench. Base 12 includes a horizontal platform 14 having a pair of end walls interconnected by a pair of side walls. A downwardly and outwardly extending apron 16 is connected to the edge of the end and side walls at an angle with respect to horizontal platform 14. As illustrated, each corner 18 of apron 16 is of rounded configuration to eliminate sharp edges. A leg 20 is provided at each corner to elevate platform 14. Each leg 20 would be disposed at the same angle that apron 16 is inclined. For example, as shown in FIG. 1 leg 20 (and apron 16) is at an angle A with respect to the side wall of platform 14. FIG. 3 shows leg 20 to be at an angle B with respect to the end wall of platform 14. Angles A and B are greater than 0° and less than 90° so as to be non-horizontal and non-vertical. Preferably both A and B are between 10° and 30° and most preferably about 20°.

The invention may be practiced by having the legs hinged to base 12 so as to be moved from an active supporting position to an inactive stored condition. Alternatively, the legs may be completely detachable to be selectively moved to the two positions. Additionally, in the preferred practice of this invention, the effective length of each leg is adjustable to provide the ability to vary the height of platform 14.

Figure 7:
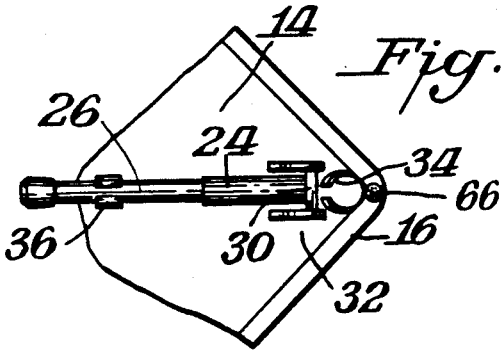
FIG. 7 is a bottom plan view of the device shown in FIG. 5.

In the embodiment of the invention illustrated in FIGS. 1-4 legs 20 are in the form of an inner tube 22 telescopically mounted in an outer tube 24. Outer tube 24 includes a series of holes 26. See for example, FIG. 5. Inner tube 22 would have a spring loaded pin 28 disposed for engagement in a selective hole. Holes 26 are spaced apart to provide, for example, two inch incremental height adjustment of platform 14. A mounting bracket 30 is provided at each corner 18 of base 12. Pivot shaft 32 is located in corresponding holes in mounting bracket 30 to permit each leg 20 to pivot from its support position shown in solid in FIG. 5 to its stored condition shown in phantom in FIG. 5 and shown in solid in FIG. 7. Snap clips 34 are provided on apron 16 to hold each leg 20 in its support or active position. Similarly, snap-clips 36 are provided on the underside of platform 14 to hold the legs 20 in their stored condition. Each leg 20 rotates about its axis a distance greater than 90° and preferably 110° to and from its stored and active positions.

As also illustrated a foot 38 is mounted on each leg 20 by being telescoped over inner tube 22. If desired foot 38 may be molded integrally with leg 20. Foot 38 serves the multiple functions of adding additional height to platform 14 and also by making foot 38 of a non-slip material the device 10 is less likely to slide or slip during the exercise program. Further because foot 38 is wider than leg 20, foot 38 also provides added stability. Similarly, a non-slip material 40 is provided on the upper surface of platform 14 to reduce the possibility of the user slipping when stepping up and down from platform 14. Alternatively, a non-slip surface may be provided by molding a non-slip design on the top surface of platform 14.

Indentations 41 may be molded at some or all of the corners of the upper surface of platform 14. Indentations 41 would function as entitlements to permit advertising bearing inserts to be mounted in indentation 41. The invention may be practiced with indentations 41 being in any exposed surface of base 12, including apron 16. Preferably each advertising insert would be flush with that surface of base 12.

Figure 4:
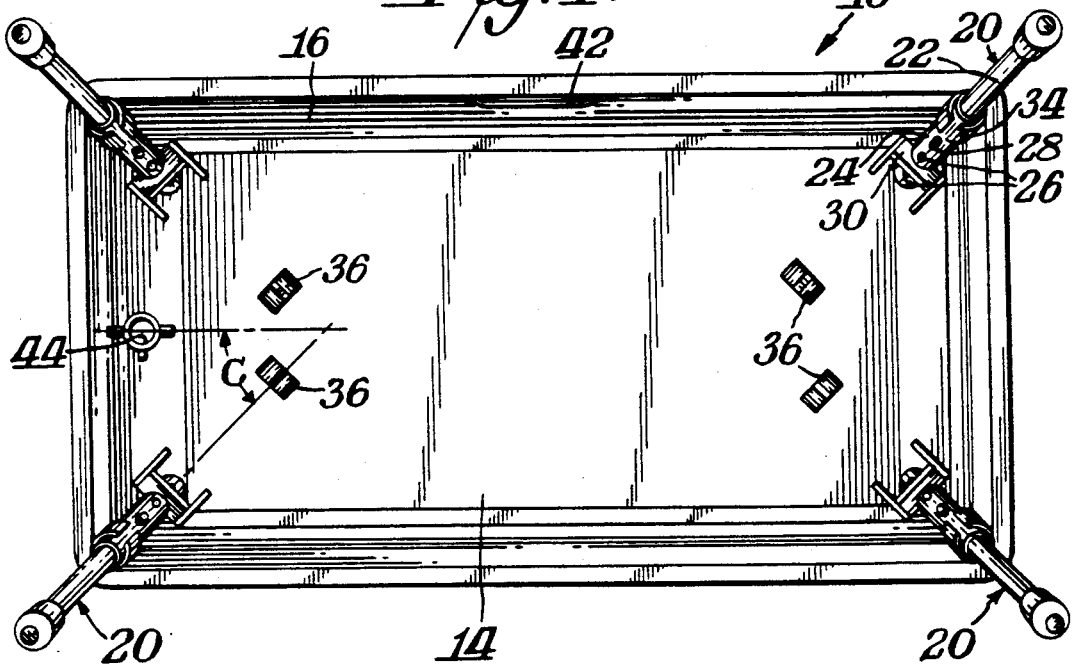
FIG. 4 is a bottom plan view of the exercise device shown in FIGS. 1–3.
Figure 6:
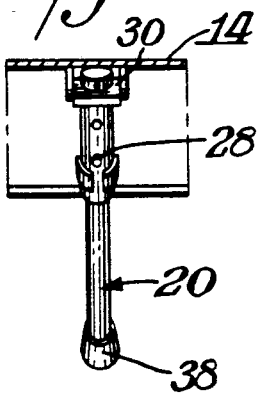
FIG. 6 is an end elevation view of the device shown in FIG. 5.
Figure 5:
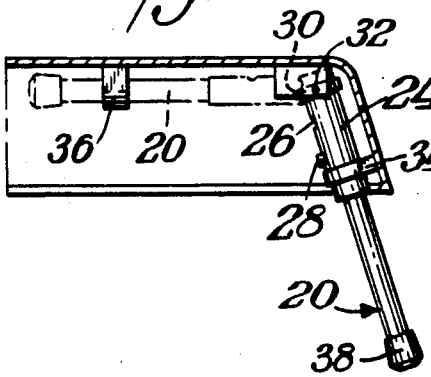
FIG. 5 is a cross-sectional view taken through FIG. 2 along the line 5—5.

Not only does each leg 20 extend downwardly at an angle of A and B in the elevation view, but also as shown in FIG. 4 each leg is at an angle C in the plan view with respect to the respective side and end walls of platform 14. Angle C is greater than 0° and less than 90° and is preferably 45°.

As also shown, for example, in FIGS. 1 and 2 a slot 42 is provided in one portion of apron 16 to act as a convenient handle for carrying the device, particularly when legs 20 are mounted in the stored condition within the periphery of apron 16 against the underside of platform 14. Alternatively, a carrying strap or handle may be utilized instead of slot 42.

Figure 8:
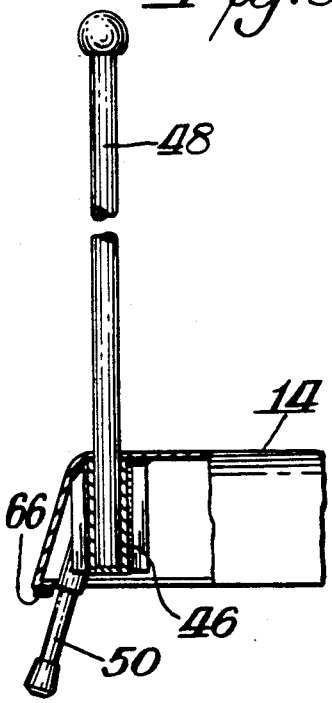
FIG. 8 is a side elevation view partly broken away of a portion of the device shown in FIGS. 1–4 and further illustrating a support post.

FIGS. 1, 4 and particularly FIG. 8 illustrate a further feature of this invention wherein an opening 44 is provided in platform 14. A tubular sleeve 46 is secured against opening 44 as best shown in FIG. 8. Sleeve 46 functions to hold a steady post 48 mounted therein so that the user would have something to hold while performing the exercise. It is emphasized, however, that device 10 generally presents an unobstructed platform to facilitate the user stepping up and down from platform 14 in any direction from either end or either side of platform 14. Thus, steady post is an optional feature which may be completely omitted. Where steady post 48 is included it is preferred that only a single such member be provided.

If desired a steady post could be mounted to base by means of an external bracket secured generally at the juncture of apron 16 and an end edge of platform 14 rather than having the hole 44 and sleeve 46.

In the preferred practice of this invention apron is a continuous apron or skirt which extends completely around the periphery of platform 14. The invention, however, may be practiced by having open areas in apron 16 such as at the corners 18 where the legs 20 would be located.

Figure 9:
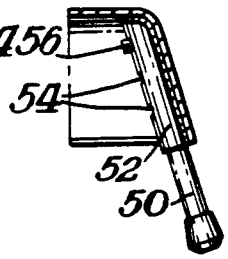
FIG. 9 is a side elevation view of a detachable leg for a device in accordance with this invention.
Figure 10:
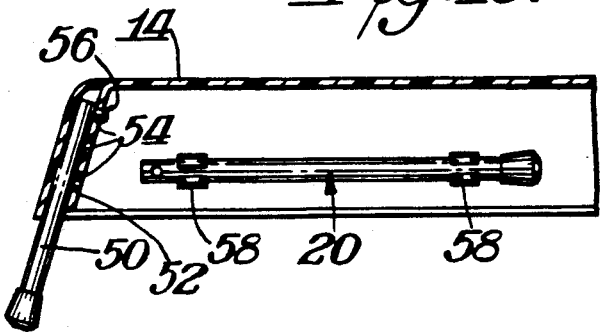
FIG. 10 is a side elevation view in section of the embodiment shown in FIG. 9.

Although the embodiment of FIGS. 1-7 illustrate legs 20 to be hinged, in a particularly advantageous practice of this invention, legs 50 are provided which are completely detachably secured to base 12 as illustrated in FIGS. 9-10. In this embodiment, legs 50 are held by guides 52 integrally formed with base 12. For example, guides 52 may be in the form of channels, grooves, brackets, tracks, post/holes or pockets integrally molded during the same operation in which base 12 is molded. A series of spaced holes 54 would be provided in these guides 52 for reception of spring pin 56 on leg 50 so as to vary the amount of extension of leg 50 from guide 52 which in turn would control the height of platform 14. Holes 54 preferably provide two inch height adjustment.

As shown in FIG. 10 mounting devices such as spring clamps 58 are secured to the inner surface of apron 16 so that legs 50 may be mounted to base 12 during the stored condition of the legs. Similarly, such spring clamps 58 may also be used to store legs of one size while legs of another size are mounted in guides 52 during the active or support condition of the legs. The stored legs may be mounted to the underside of platform 14 or the inside of apron 16. If desired clamps or grooves could be molded to apron 16 to store the legs.

Figure 11:
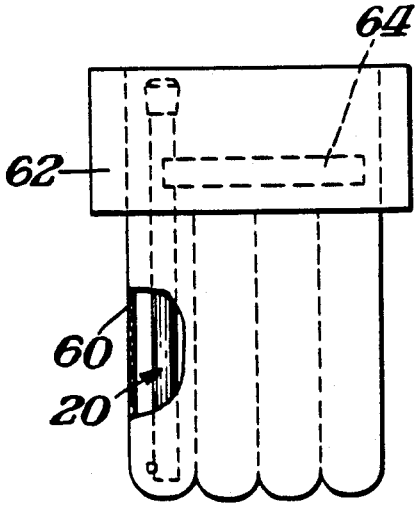
FIG. 11 is a top plan view partly broken away showing a pouch for holding sets of legs usable with the device of this invention.

FIG. 11 illustrates a further feature of this invention wherein a storage pouch 60 is provided of a size and shape to package or hold sets of legs 50. The storage pouch could include for example an openable flap 62 having a hook and loop material, such as sold under the trademark VELCRO, strip 64 for selective opening and closing of the flap to provide or prevent access to the legs stored in pouch 60. Pouch 60 could be placed within the periphery of apron 16 during the transport and storage of device 10.

Legs 50 may be of singular tubular construction or legs 50 may also take the same form as legs 20 to provide added length adjustment. In this respect, legs 50 could be formed as an inner tube telescopically mounted in an outer tube.

A further feature of this invention is the provision of spring members in the legs 20 or 50 to lessen the climbing impact when the user steps onto platform 14. The spring members would also provide energy return to produce a bounce effect.

In the preferred practice of this invention apron 16 would be dimensioned so that when apron 16 is placed directly on the floor platform 14 would be disposed 4 inches above the floor. Apron 14 may be provided with an edge made of a non-slip material such as rubber to facilitate the use of base 12 being placed directly on the floor where the exercise program would have the user step at a height of 4 inches. Apron 16 may, for example, have rubber grommets 66 at the corners as shown in FIG. 8. Device 10 is so constructed that the height of platform 14 above the floor could be incrementally increased by two inch increments from four inches to 14 inches For example, for beginners an exercise program might require a height in the range of 4–10 inches whereas an advanced program might require a height of 10–14 inches Accordingly, the minimum height of four inches could be achieved by mounting base 12 directly on the floor without the use of any legs or feet. Feet 38 could be dimensioned to add, for example, one inch elevation. In the preferred practice of this invention two sets of legs having differing lengths would be provided. For example, the shorter set of legs could be utilized for the beginner program and the longer set of legs for the advanced program. The 2 inch increments could be achieved by providing extendability of each set of legs in 2 inch increments and then shifting from one set of legs to another when a greater or lesser height is required In the preferred practice of this invention, platform 14 would be dimensioned longer and wider than a conventional stool and would, for example, be 28×14 inches with a height of 4 inches because of its angled apron 16.

Platform 14 could be given added strength by forming ribs on its underside.

If desired, each foot 38 could be mounted to its leg in the same manner that the leg is mounted to the base by having adjustable telescopic positioning of each foot over its respective leg. This would likewise provide for additional height flexibility.

In use the exercise program could thus be performed by using the base alone or by using the base with short legs or by using the base with short extended legs or by using the base with long legs or by using the base with long extended legs or by additionally providing feet including adjustably mounted feet on the legs.

Device 10 may be formed in any suitable manner. In the preferred practice of the invention device 10 is made from a plastic material which is injected or blow molded. Device 10 may however be stamped from a metal material. An advantage of the tapered apron 16 is that a plurality of such devices may be stacked within each other.

Figure 12:
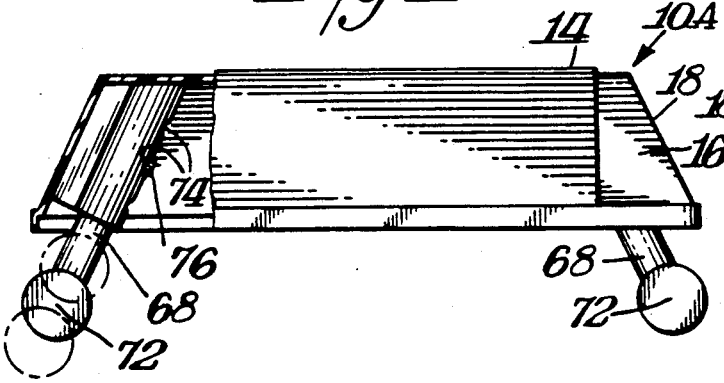
FIG. 12 is a side elevation view partly in section of an alternative device in accordance with this invention.
Figure 13:
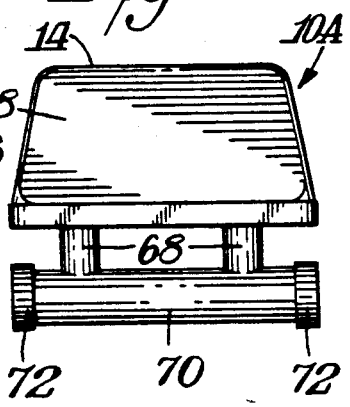
FIG. 13 is an end elevation view of the device of FIG. 12.

FIGS. 12–13 show a further embodiment wherein device 10A includes a pair of legs 68,68 at each end of base 12 integrally connected to each other by a single foot 70 having non-slip end caps 72,72. This embodiment illustrates that the legs may but need not be secured at the corners of base 12. As shown in FIG. 13 the legs 68,68 are mounted inwardly of corners 18,18. The U-shaped unit comprising legs 68,68 and foot 70 may be mounted in any suitable manner. As shown in FIG. 12 each leg 68 is inserted into a channel 74 integral with apron or skirt 16 and is selectively held in position by spring pin 76 engaged in one of a selected number of holes in channel 74.

Figure 16:
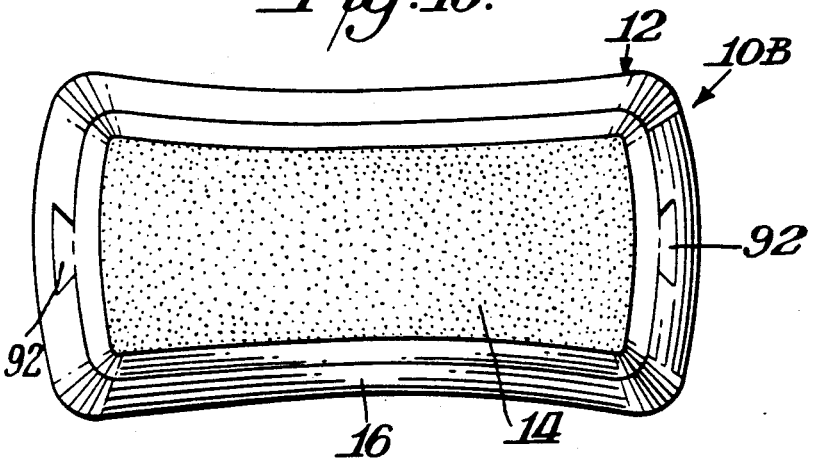
FIG. 16 is a top plan view of the device of FIGS. 14–15.
Figure 14:
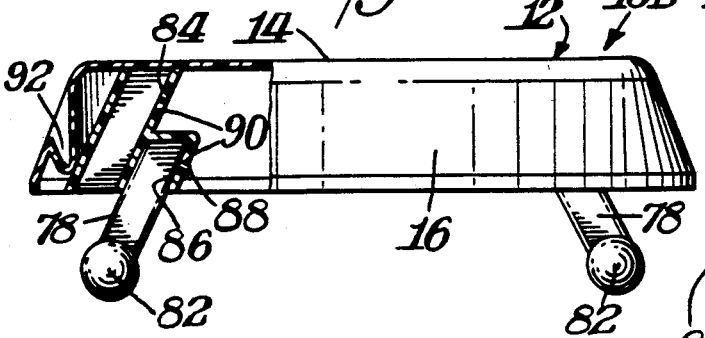
FIG. 14 is a side elevation view partly in section of a further alternative device in accordance with this invention.
Figure 15:
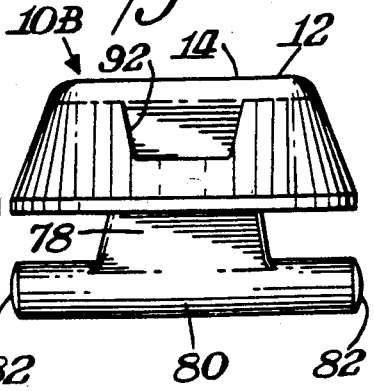
FIG. 15 is an end elevation view of the device of FIG. 14.

FIGS. 14–16 illustrate yet other variations of this invention. As shown therein with device 10B a single wide leg 78 is provided at each end of base 12. An elongated foot 80 is integral with leg 78. End caps made of non-slip material may be mounted on foot 78 or the ends 82 may simply be rounded.

FIG. 14 illustrates a particularly advantageous manner of mounting the legs to provide height adjustability. Instead of having a series of holes for adjustability at least two side by side slots or channels 84,86 are integrally formed on apron 16. The channels are made of different lengths. For example, when leg 78 is inserted completely into long channel 84, it will elevate platform another two inches. When, however, leg 78 is completely inserted into short channel 86, platform 14 will be elevated four inches. Leg 78 may be locked into a respective channel in any suitable manner such as by spring pin 88 on leg 78 snapping into a hole 90 in the channel wall. This manner of height adjustability may, of course, be utilized in the other embodiments.

Other variations illustrated in FIGS. 14–16 include the provision of indents 92 in the opposite ends of apron 16. Indents 92 may be used to grasp base 12 when carrying the device. As illustrated in FIG. 16, platform 14 need not be rectangularly shaped. As shown the side walls of base 12 are inwardly bowed. If desired the ends and/or sides of base 12 may be inwardly or outwardly bowed.

The dimensioning of the platform, particularly with no above surface frame so that it is unobstructed on all four sides is particularly advantageous for aerobic routines. The invention can be practiced by having, for example, a single base with two sets of extensions or if desired by having two bases each with its own extensions for legs.

As can be appreciated, device 10 thus provides an exercise device wherein the height can be readily varied in a number of different manners. Moreover, by being able to store the legs within the periphery of the apron the resultant device is compact, lightweight and space saving.

What is claimed is:

1. An exercise device for use in aerobic step climbing routines/programs comprising a base, said base consisting of a horizontal platform having opposite ends and intermediate sides with a downwardly and outwardly extending apron, a corner where each of said ends is joined to its adjacent side, and at least two legs, said apron being disposed at an angle from greater than 0° to less than 90° from vertical and bearing at least two separate means for receiving said legs mounted to said base against said apron and at the same angle as said apron, and each of said legs being selectively mounted in one of said receiving means, whereby said legs are positioned for differing extensions from said base to adjust the height of said platform.

2. The device of claim 1 wherein said legs are mounted at opposite ends of said base, and an elongated foot secured to each of said legs.

3. The device of claim 2 wherein a pair of legs is mounted at each end of said base, and said foot being integrally joined to its pair of legs to form a U-shaped unit.

4. The device of claim 2 wherein a single widened leg is mounted at each of said ends integral with its foot.

5. The device of claim 1 wherein said receiving means comprises a pair of side by side channels of differing length is secured to said apron at each end thereof for selectively receiving one of said legs to provide the height adjustability of said platform.

6. The device of claim 1 wherein angle is between 10° and 30°.

7. An exercise device comprising a base, said base consisting of a horizontal platform having a periphery formed by opposite ends and intermediate sides with a downwardly extending apron, at least two sets of channels in said base, each of said sets comprising at least two side by side parallel channels formed in said base at opposite portions of said periphery, each of said channels in each of said sets being of differing depth than each other whereby a leg may be selectively detachable received in each of said channels to provide said platform with at least three levels of height adjustability wherein there is one height level when no leg is in any channel and said apron is placed directly on a support surface and there are other height levels in accordance with which channel a leg is inserted.

8. The device of claim 7 including locking elements in each of said channels for detachably locking a leg therein.

9. The device of claim 8 including a leg detachably mounted in one of said channels in each of said sets, and said channels being at opposite ends of said base.

10. The device of claim 9 wherein said channels are formed in said apron.

11. The device of claim 10 wherein said apron and said channels are inclined outwardly away from said platform.

12. The device of claim 11 wherein an elongated foot is secured to each of said legs remote from said platform, and said foot extending parallel to said platform.

13. The device of claim 12 wherein each of said legs extends from the central portion of each of said ends of said base.

14. The device of claim 10 wherein a set of said channels is provided at each corner of said base where a respective one of said ends and intermediate sides intersect.

15. The device of claim 10 wherein each leg at an end of said base is connected to a corresponding leg at the same end of said base by an elongated foot.

16. The device of claim 10 including non-slip material at each end of said foot.

17. The device of claim 7 wherein said sides are bowed toward each other.

18. The device of claim 7 including an indent formed in said apron to facilitate the carrying of said device.

19. The device of claim 1 wherein said locking elements comprise a hole in the wall of each of said channels, and each of said legs having a pin for selective detachable insertion in a respective hole.

20. The device of claim 7 including a non-slip material secured to the lower edge of said apron to facilitate the use of said base without legs being attached thereto.

21. The device of claim 7 including a non-skid surface on said platform.

22. A method of performing an aerobic exercise comprising providing a base consisting of a horizontal platform and there being a set of at least two side by side parallel channels extending downwardly from each end of the platform with the channels of each pair being of different depth, inserting a leg in a respective channel in each of said sets of channels to elevate said platform to a predetermined height in accordance with which of said channels said leg is inserted into, and repeatedly stepping onto and off of said platform.

23. An exercise device for use in aerobic step climbing routines/programs comprising a base, said base consisting of a horizontal platform having opposite ends and intermediate sides with a downwardly extending apron, a corner where each of said ends is joined to its adjacent side, and at least two legs, said base having at least two separate means for receiving said legs mounted to said base, and each of said legs being selectively mounted in one of said receiving means, whereby said legs are positioned for differing extensions from said base to adjust the height of said platform.

24. The device of claim 23 wherein one of said receiving means is disposed closer to said platform than the other of said receiving means.

25. The device of claim 24 wherein said platform has an undersurface, said one receiving means including said underside as its top wall whereby its respective leg is disposed against said undersurface when said leg is received by said one receiving means.

26. The device of claim 23 wherein one of said receiving means is disposed closer to its respective end of said base than the other of said receiving means.

27. The device of claim 23 wherein two sets of said receiving means are provided at each end of said base with one of each of said receiving means being generally located at each of said corners but inwardly of its corner.

28. The device of claim 27 wherein said legs comprise a set of two legs at each end of said base, and a foot being integrally joined to its set of two legs to form a U-shaped unit.

29. The device of claim 23 wherein a non-slip material is on said lower surface of said apron and of said legs, and a non-skid material being on the upper surface of said platform.

30. The device of claim 29 wherein said non-slip material on said lower surface of said apron is located generally at each of the corners of said lower surface.

31. The device of claim 23 wherein said apron extends downwardly and outwardly from said platform at an angle greater than 0° and less than 90° from vertical, and said apron extends completely around the periphery of said platform.

32. The device of claim 31 wherein at least a portion of said legs is at the same angle as said apron.

33. The device of claim 32 wherein said ends and said sides of said platform are bowed, said corners being rounded, and said platform being at the uppermost portion of said device whereby said platform is unobstructed.

34. The device of claim 33 wherein the distance between the upper surface of said platform and the lower surface of said apron is four inches, said platform being elevated in two inch increments in accordance with which of said receiving means is utilized for receiving said legs, said sides of said platform being about 28 inches long, and said ends of said platform being about 14 inches long.

35. The device of claim 34 wherein strengthening ribs are on the underside of said platform, and said base being made of plastic material.

36. The device of claim 34 wherein one of said receiving means is disposed closer to said platform then the other of said receiving means, said platform having an undersurface, said one receiving means including said undersurface as its top wall whereby its respective leg is disposed against said undersurface when said leg is received by said one receiving means, said receiving means being located at different distances from the ends of said apron, two sets of said receiving means being at each end of said base with one of each of said receiving means being generally located at each of said corners but inwardly of its corner, said legs comprising a set of two legs at each end of said base, a foot being integrally joined to the set of two legs to form a U-shaped unit, a non-slip material being on the lower surfaces of said apron and of said legs, said non-slip material on said lower surface of said apron being located generally at each of the corners of said lower surface, and a non-skid material being on the upper surface of said platform.

37. The device of claim 25 wherein said receiving means are located at different distances from the ends of said apron, two sets of said receiving means being at each end of said base with one of each of said receiving means being generally located at each of said corners but inwardly of its corner, said legs comprising pair of legs at each end of said base, and a foot being integrally joined to each pair of legs to form a U-shaped unit.

* * * * *